US006658686B1

(12) United States Patent
Lee

(10) Patent No.: US 6,658,686 B1
(45) Date of Patent: Dec. 9, 2003

(54) ROTARY DISC TOOTHBRUSH

(76) Inventor: Soo-Woong Lee, 21821 Burbank BL #156, Woodland Hills, CA (US) 91367

( * ) Notice: Subject to any disclaimer, the term of this patent is extended or adjusted under 35 U.S.C. 154(b) by 0 days.

(21) Appl. No.: 10/339,841

(22) Filed: Jan. 10, 2003

Related U.S. Application Data

(60) Provisional application No. 60/386,466, filed on Jun. 5, 2002.

(51) Int. Cl.[7] ..... A46B 9/04; A46B 13/00

(52) U.S. Cl. ..... 15/27; 15/23; 15/28; 15/167.2

(58) Field of Search ..... 15/23, 27, 28, 15/167.2; 601/141, 142

(56) References Cited

U.S. PATENT DOCUMENTS

| | | | | |
|---|---|---|---|---|
| 2,279,982 | A | | 4/1942 | Glynn |
| 2,758,326 | A | * | 8/1956 | Keely |
| 3,258,802 | A | * | 7/1966 | Rodriguez |
| 4,225,994 | A | | 10/1980 | Stoltz |
| 4,979,256 | A | * | 12/1990 | Branford |
| 5,035,020 | A | * | 7/1991 | Winiewski |
| D330,287 | S | * | 10/1992 | Wise |
| 5,177,827 | A | | 1/1993 | Ellison |
| 5,699,575 | A | | 12/1997 | Peifer |
| 5,794,296 | A | | 8/1998 | Wong |
| 5,864,911 | A | | 2/1999 | Arnoux et al. |
| 6,471,300 | B1 | * | 10/2002 | Tomiyama |
| 6,477,729 | B1 | * | 11/2002 | Ben-Ari |

FOREIGN PATENT DOCUMENTS

| | | | |
|---|---|---|---|
| FR | 829086 | * | 3/1938 |
| GB | 24566 | * | 11/1902 |
| IT | 277685 | * | 9/1930 |

OTHER PUBLICATIONS

Glickman's Clinical periodontology pp 729–738 ISBN 0–7216–2440–5 copyright 1979.

* cited by examiner

*Primary Examiner*—Randall E. Chin
(74) *Attorney, Agent, or Firm*—Ralph D. Chabot

(57) ABSTRACT

A toothbrush design which more effectively permits bristle penetration into the spaces between tooth and gum for removal of plaque and food debris lodged within these spaces. The toothbrush design incorporates a rotatable brush disc having a plurality of radially outward extending bristles but where the width of the bristle disc and number of bristles are preferably limited so that the bristle tips can penetrate into the space between tooth and gum and preferably be of sufficient length to penetrate to the bottom of the space.

6 Claims, 1 Drawing Sheet

ROTARY DISC TOOTHBRUSH

PRIORITY CLAIM

This application claims the priority of U.S. Provisional Application bearing serial No. 60/386,466 filed on Jun. 5, 2002.

TECHNICAL FIELD

This invention relates to the field of dental hygiene.

BACKGROUND OF THE INVENTION

Many individuals suffer from periodontal disease. The term "periodontal" is generally defined as the area around the tooth. This includes the gum, periodontal membrane and bone tissue holding a tooth in place. If periodontal disease is diagnosed, dental surgery is typically required to correct the gum condition. Following surgery, it is necessary to keep the space, or sulcus, between the teeth and gum clean. This is critical for successful healing and improving the gum to a healthy condition.

The healing process following periodontal surgery is critical. Typically, immediately following surgery, the sulcus is filled with temporary protective packing for approximately one to two weeks. Gum swelling resulting from surgery has, after this period of time, subsided to the point where tooth brushing can begin. Dental plaque and food debris must thereafter be kept to a minimum in the sulcus for the gums to continue to heal correctly.

Good oral hygiene for gum healing is one of the most effective dental prophylaxes. For this reason, it is critical to obtain an effective penetration of the toothbrush bristle tips into the sulcus.

To properly clean the sulcus, many experts recommend that the bristle tips must reach to the bottom of the sulcus in order to remove all debris and plague.

Commonly known among dentists is the Bass Method, a method for properly brushing the tooth and sulcus. The Bass Method is considered the most efficient tooth brushing technique yet most people are either not familiar, or simply don't know how to properly perform.

Most individuals tend to brush only the prominent tooth surfaces, which are usually self-cleaned simply by eating fibrous foods such as meats and vegetables.

Proper use of the Bass Method requires a portion of the bristle tips to be in contact and thereafter movement of the toothbrush with a short back-and-forth motion without dislodging the tip of the bristles from their contact.

The Bass Method could be more efficiently implemented if a user could insert at least a few of the toothbrush bristle tips to the bottom of the sulcus. Unfortunately, the conventional toothbrush is not designed for its bristles to penetrate completely into the space between the tooth and gum.

Specifically, the conventional toothbrush typically has an excessive bristle surface area making it extremely difficult for individuals to position the bristles for penetration into the sulcus.

Typical toothbrushes are used to sweep their bristles back and forth across the surfaces of tooth and gum in proplylaxis. In other words, the bristles slide over small spaces between teeth and between the tooth and gum. This bristle action, because of it sliding over the spaces, actually passes over plaque and food debris, or can even force such material deeper into the space.

When a toothbrush is used in this conventional manner, the bristle tips are not properly positioned to be inserted into, nor do they have the necessary contact time within the sulcus to effectively remove plaque and food debris.

SUMMARY OF THE INVENTION

The present invention introduces a new technique and toothbrush design, which permits necessary bristle penetration into the sulcus for effective removal of plaque and food debris lodged within these spaces.

Rather than sweeping the bristles across the tooth and gum, my modified toothbrush comprises an elongated body defining a handle which connects to a rotatable brush disc. The brush disc includes a plurality of radially outward extending bristles. The width of the bristle disc and number of bristles are limited so that an effective number of the bristle tips present on the disc can, when properly positioned, penetrate into the space between tooth and gum and preferably be of sufficient length to penetrate to the bottom of the sulcus.

It is not necessary that the bristles' width i.e. the number of bristles across the bristle disc, be limited to only the width of the space between tooth and gum. What is necessary is that the overall design of the toothbrush permits a user to easily and efficiently insert a sufficient number of bristles into the sulcus for cleaning.

Preliminary Testing

In preliminary testing which preceded my final design, a standard toothbrush was modified; specifically, reducing the number of bristles by reducing the bristle surface area. The surface area was reduced so that bristle tips could be more easily inserted into the sulcus. However, patients found it difficult to implement the technique of inserting the bristles into the small space between the tooth and gum.

Further, the modified toothbrush could function properly only when the integrity and alignment of the bristles which penetrate into the sulcus were maintained in a substantially straight and rigid form during the application of the pressured strokes of the Bass Method described above.

In order to function properly, the bristle tips penetrate to the base of the sulcus. Short strokes are then used while the bristle tips are engaging or digging into the gum located at the base of the sulcus so that the bristle tips do not dislodge. After completion of the strokes, the brush is first moved vertically so the tips dislodge, then moved across to an adjacent area and the same procedure is repeated. A more detailed description of this method now follows:

A toothbrush is held using a grip at two points on the brush handle. One point would be the midpoint on the backside of the brush handle, which would be pressed with the index finger. The second point would be on the front side of the handle (same side as the bristles), which would rest against the palm of the hand. With the bristles resting on the gum-line and slight pressure applied on these two points, when minimal back and forth motion is applied, the toothbrush will be secure enough in the hand of the user to make the bristles penetrate into the small gum spaces.

While the intended results were obtained, the required brushing instructions again turned out to be difficult to follow.

Based on the difficulties associated with using bristles rigidly affixed to a brush head to clean the spaces between tooth and gum, a toothbrush was designed which is easy to orientate to the correct cleaning position and provide an effective cleaning of the space between tooth and gum.

Improved Toothbrush Design

The brush design can be incorporated for both manual and electric toothbrushes. This invention can be efficiently used as an attachment to an electric toothbrush. The strokes generated by the electric toothbrush would drive the bristles of the rotary disc or bristle wheel into the sulcus. Bristle tips are designed to conform or adapt to the shape of the tooth and gum using the motion of the strokes generated by the electric toothbrush.

The brush design can also incorporate either single or dual rotary discs, which will be discussed below. Finally, each design can also include a separate set of bristles for the conventional brushing technique of sweeping across the tooth surface, as found on a standard toothbrush.

The present invention cleans not only the tooth surface and interproximal portion between the teeth, but also facilitates the healing of simple gingivitis (minor gum inflammation). And unlike the bristles found on a conventional toothbrush which are dragged across the tooth surface in a back and forth, and up and down motion; my rotary toothbrush is designed so that an effective number of bristle tips can penetrate into the sulcus.

My design incorporates bristles that extend radially outward from a disc rotatably mounted to a toothbrush handle.

A. Single Rotary Bristle Design

When positioned properly, rotary bristles are inserted into the sulcus. Once in position, the user slowly moves the brush in a substantially horizontal direction while maintaining a constant downward force on the toothbrush so that the bristle tips will reach to the base of the sulcus. Once in position and while maintaining sufficient force on the bristle tips to keep them in contact with the gum at the base of the sulcus, short strokes are then applied.

Afterwards, rather than lifting the bristle tips by vertically moving the toothbrush, the downward force which was applied is now released and the toothbrush is displaced in a substantially horizontal direction so that the bristle disc rotates so that different bristle tips will be in position for engagement with the base of the sulcus. As the toothbrush is moved, the bristle disc also will rotate and impart a cleaning force to dislodge the debris and carry it up above the gum line.

By taking into account that bristles must be able to penetrate into the sometimes abnormally deep sulcus formed by the tooth and gum it is envisioned that many new toothbrush designs can be developed based upon my rotatable disc design.

B. Dual Rotary Bristle Design

One design alternative is to use a dual bristle disc design. While one bristle disc is in position to clean the gum and teeth, the second disc is sufficiently spaced from the other. Disc spacing can help to maintain a proper angle, linear direction and position of the first disc while simultaneously cleaning the top surface of the teeth with the second disc.

Use of a rotary disc design, either single or dual, permits the bristle tips, provided they have the appropriate length, to penetrate into the deepest regions of the sulcus between tooth and gum, while allowing the discs to rotate freely when the toothbrush is moved for cleaning an adjacent area.

The bristles extending from the bristle disc can conform to the adjacent shape of the tooth and gum, so that the bristle disc within the sulcus can freely rotate according to the resistance met by the downward force applied to the bristles in contact with the gum at the base of the sulcus. The bristle tips can reach the deepest area between tooth and gum because of my new design which orientates bristles for insertion into the sulcus rather than for perpendicular contact with the tooth surface.

Because perpendicular contact with the tooth surface is minimized, this diminishes the bristle resistance associated with the tooth surface, and, as a result, more bristles are available for penetration into the surrounding crevices and spaces, and actively dig and remove food debris and other substances from the deep spaces of the sulcus.

As mentioned earlier, my invention can incorporate a second set of bristles; these being the traditional toothbrush bristles located on the side of the disc, extending in a perpendicular direction away from the bristle disc. This second set can be used to brush and polish the prominent tooth surfaces.

Some of the objectives of my invention can be summarized as follows:

To design a toothbrush having a rotatable brush disc that will work along the gingival crevice by means of a linear rolling motion;

To design a toothbrush having a rotatable bristle disc which is free from the dragging force of the bristles during brushing;

To design a toothbrush where the bristle tips associated with the toothbrush could penetrate deep into the sulcus, contact the base of the gum and not be dislodged during the implementation of short cleaning strokes;

To design a toothbrush that incorporates a small bristle tip surface area on the plurality of rotary extending bristles for easy penetration of the bristle tips into the sulcus.

DETAILED DESCRIPTION OF THE PREFERRED EMBODIMENT

Figure 1:
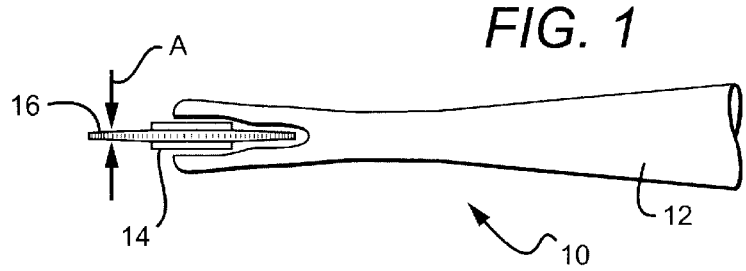
FIG. 1 is a side view of my single rotary bristle design.

My improved toothbrush 10 is depicted generally in FIG. 1. Toothbrush 10 comprises an elongated handle 12 and a bristle disc 14 rotatably connected to handle 12 by the use of an axle. A plurality of bristles 16 extend radially away from disc 14. The width of the bristles on the disc is depicted by "A". The bristle width is limited so that an operatively effective number of bristles will be able to penetrate into the space between the tooth and gum and effectively clean out plaque or food debris which may be present therein.

Figure 2:
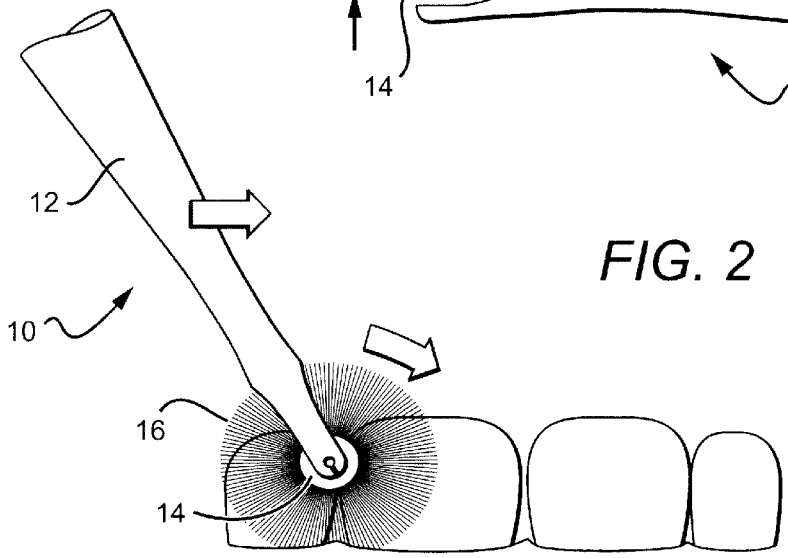
FIG. 2 is an alternative side view of the bristle design depicted in FIG. 1 illustrated in position for cleaning the space between tooth and gum.

Because an axle is used, the orientation of handle 12, relative to disc 14, can vary along a single plane. This permits a user to vary the position of handle 12 while a portion of bristles 16 still remain in the space between tooth and gum as shown in FIG. 2.

Figure 3:
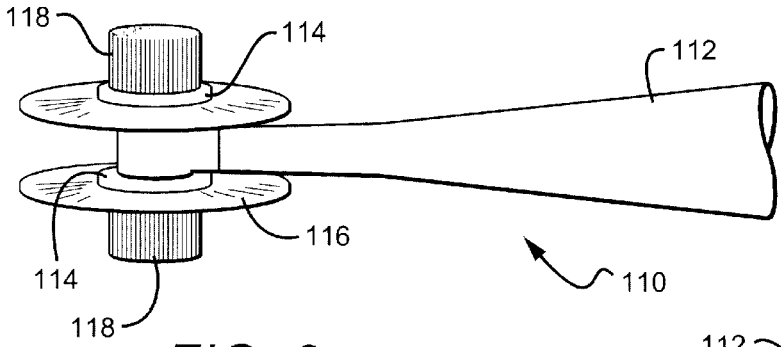
FIG. 3 is a perspective view of a dual rotary bristle design and a second set of brushing bristles for each disc.
Figure 4:
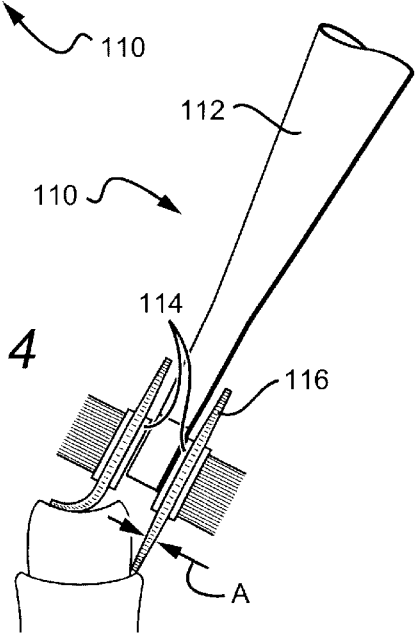
FIG. 4 is an alternative perspective view of the bristle design depicted in FIG. 3 illustrated in operable engagement to a tooth.

In an alternative design, a dual disc or wheel system is illustrated in FIGS. 3 and 4. The toothbrush 110 has an elongated handle 112 and a pair of bristle discs 114 located on opposing sides of an axle whereby both discs 114 are rotatably connected to handle 112. A plurality of bristles 116 extend radially away from each disc 114 as in the single disc embodiment.

In the dual disc design, one set of rotary bristles is positioned along the top of the tooth surface as depicted in FIG. 4. In this position, the bristles are shown to deform while in contact with the tooth surface. The other set of rotary bristles penetrate into the space between the tooth and gum for cleaning.

Operation of the toothbrush is relatively simple. The user will position the bristles so that a portion of the plurality of bristles penetrate into the space between tooth and gum as best shown in FIG. 2.

Once in position, the user will displace the bristle disc by moving handle 12 in generally parallel direction relative to the top surface of the teeth. As handle 12 is displaced, a portion of bristles 16 on disc 14 will penetrate into the gum space and then exit as disc 14 rotates carrying debris dislodged by bristles 16.

Because of the rotary design, a portion of bristles 16 remain penetrated within the space between tooth and gum as handle 12 is displaced as noted above.

The dual rotary design can also incorporate a second set of brushing bristles 118 as depicted in FIG. 3 and 4. Brushing bristles 118 can be used for typical brushing as with a standard toothbrush.

I claim:

1. A toothbrush comprising:

an elongated body defining a handle;

a pair of bristle discs each rotatably connected to said handle, said bristle discs each comprising a first plurality of bristles radially extending outward where the distance axially across said plurality of bristles is sufficiently limited to permit a portion of said plurality of bristles to extend into the space between tooth and gum where said bristle disc will rotate within said space as the handle is displaced in a substantially parallel direction relative to the space between tooth and gum;

said first plurality of bristles is of sufficient length so as to extend substantially to the base of the space between tooth and gum; and, where a second plurality set of bristles extend away from at least one of said bristle discs in a substantially perpendicular direction relative to said first plurality set of bristles.

2. The toothbrush of claim 1 where said toothbrush is an electric toothbrush.

3. A toothbrush comprising:

an elongated body defining a handle; and, a pair of bristle discs each rotatably connected to said handle, said bristle discs each comprising a first plurality of bristles radially extending outward where a portion of said plurality of bristles can extend into the space between tooth and gum, and when a portion of said first plurality of bristles is partially within said space, the respective bristle disc will rotate in response to the handle displaced in a substantially parallel direction relative to the space between tooth and gum; and, where a second plurality set of bristles extend away from at least one of said bristle discs in a substantially perpendicular direction relative to said first plurality set of bristles.

4. The toothbrush of claim 3 where said toothbrush is an electric toothbrush.

5. A toothbrush comprising:

an elongated body defining a handle; and, a pair of bristle discs each rotatably connected to said handle, said bristle discs each comprising a first plurality of bristles radially extending outward; and, where a second plurality set of bristles extend away from at least one of said bristle discs in a substantially perpendicular direction relative to said first plurality set of bristles.

6. The toothbrush of claim 5 where said toothbrush is an electric toothbrush.

* * * * *